US008155373B2

(12) United States Patent
Kosuda et al.

(10) Patent No.: US 8,155,373 B2
(45) Date of Patent: Apr. 10, 2012

(54) ELECTROACOUSTIC TRANSDUCER

(75) Inventors: Kazuyuki Kosuda, Neyagawa (JP); Yuki Hatanaka, Daito (JP)

(73) Assignee: SANYO Electric Co., Ltd., Moriguchi-shi, Osaka (JP)

( * ) Notice: Subject to any disclaimer, the term of this patent is extended or adjusted under 35 U.S.C. 154(b) by 1135 days.

(21) Appl. No.: 11/928,281

(22) Filed: Oct. 30, 2007

(65) Prior Publication Data

US 2008/0101649 A1 May 1, 2008

(30) Foreign Application Priority Data

Oct. 31, 2006 (JP) ..... 2006-297137

(51) Int. Cl.
*H04R 1/00* (2006.01)
*H04R 9/06* (2006.01)
*H04R 11/02* (2006.01)

(52) U.S. Cl. ..... 381/412; 381/396

(58) Field of Classification Search ..... 381/412, 381/396, 398, 413, 423, 190, 395, 420
See application file for complete search history.

(56) References Cited

U.S. PATENT DOCUMENTS

| | | | | |
|---|---|---|---|---|
| 2002/0061116 | A1* | 5/2002 | Hara et al. | 381/413 |
| 2004/0008858 | A1* | 1/2004 | Steere et al. | 381/398 |
| 2004/0086147 | A1* | 5/2004 | Koura et al. | 381/412 |
| 2005/0220320 | A1* | 10/2005 | Kim et al. | 381/396 |

FOREIGN PATENT DOCUMENTS

| | | | |
|---|---|---|---|
| JP | 57-046394 | U | 8/1980 |
| JP | 1-122691 | U | 8/1989 |
| JP | 09-331596 | A | 12/1997 |
| JP | 2001-211496 | A | 8/2001 |
| JP | 3208310 | B2 | 9/2001 |
| JP | 3213521 | B2 | 10/2001 |
| JP | 2003-125486 | A | 4/2003 |
| JP | 2003-169393 | A | 6/2003 |
| JP | 2004-072647 | A | 3/2004 |
| JP | 2004-517591 | A | 6/2004 |
| JP | 2005-223720 | A | 8/2005 |
| JP | 2005-286984 | A | 10/2005 |
| JP | 2006-173997 | A | 6/2006 |
| WO | 02/060220 | A1 | 8/2002 |

OTHER PUBLICATIONS

Japanese Office Action dated May 31, 2011, issued in corresponding Japanese Patent Application No. 2006-297137.

* cited by examiner

*Primary Examiner* — Walter L Lindsay, Jr.
(74) *Attorney, Agent, or Firm* — Westerman, Hattori, Daniels & Adrian, LLP

(57) ABSTRACT

An electroacoustic transducer of the present invention includes a diaphragm 3 having a periphery as a fixed end, a coil 4 having an axis perpendicular to the diaphragm 3 and 6 attached centrally to the diaphragm 3, and a direct current magnetic field generator fixed in position as spaced apart from the coil 4 by a gap provided axially of the coil 4. The diaphragm 3 is driven by applying to the coil 4 a magnetic flux emitted from a surface of the direct current magnetic field generator that faces the coil 4. The direct current magnetic field generator includes a ring-shaped outer magnet 5 located coaxially with the axis of the coil 4 and magnetized in the direction perpendicular to the axis, and an inner core 6 including a ferromagnet and located in the central hole of the outer magnet 5.

26 Claims, 19 Drawing Sheets

ELECTROACOUSTIC TRANSDUCER

The priority application Number 2006-297137 upon which this patent application is based is hereby incorporated by reference.

BACKGROUND OF THE INVENTION

1. Field of the Invention

The present invention relates to electroacoustic transducers for converting electrical signals into sound, such as loudspeakers, and particularly to electroacoustic transducers having a structure effective in reducing the thickness.

2. Description of Related Art

A loudspeaker includes a diaphragm vibrated by supplying a driving current to a coil attached to the diaphragm and applying to the coil a magnetic flux emitted from a direct current magnetic field generator including a magnet.

For example, a conventional loudspeaker of outer magnet type shown in FIG. 31 includes a coil 9 wound into a cylinder, a ring-shaped magnet 90 and a columnar pole 95 located outside and inside the coil 9, respectively, an upper plate 97 attached to the front face of the magnet 90, and a bottom plate 96 attached to the rear face of the pole 95 and magnet 90. In this loudspeaker, the coil 9 is located in a magnetic field formed in a cylindrical gap between the pole 95 and the upper plate 97, so that the coil 9 will be driven.

A conventional loudspeaker of inner magnet type shown in FIG. 32 includes a coil 9 wound into a cylinder, a disk-like magnet 92 and a cup-like yoke 99 located inside and outside the coil 9, respectively, and a plate 98 attached to the front face of the magnet 92. In this loudspeaker, the coil 9 is located in a magnetic field formed in a cylindrical gap between the plate 98 and the yoke 99, so that the coil 9 will be driven.

Another conventional loudspeaker of outer magnet type shown in FIG. 33 includes a coil 91 wound into an angular cylinder, a pair of magnets 93, 93 and a pole 95 each in the form of a rectangular parallelepiped located outside and inside the coil 91, respectively, upper plates 97, 97 attached to the front faces of the magnets 93, 93, and a bottom plate 96 attached to the rear face of the pole 95 and magnets 93. In this loudspeaker, the coil 91 is located in a magnetic field formed in a gap between the pole 95 and the upper plates 97, 97, so that the coil 91 will be driven.

Another conventional loudspeaker of inner magnet type shown in FIG. 34 includes a coil 91 wound into an angular cylinder, a tabular magnet 94 and a box-like yoke 99 located inside and outside the coil 91, respectively, and a plate 98 attached to the front face of the magnet 94. In this loudspeaker, the coil 91 is located in a magnetic field formed in a gap between the plate 98 and the yoke 99, so that the coil 91 will be driven.

However, all of the above conventional loudspeakers have a problem in that they are difficult to make thinner because the coil greatly protrudes beyond the front face of the yoke. Accordingly, there has been proposed a thin loudspeaker shown in FIG. 35 (see JP 3213521, B). This loudspeaker includes a frame 100 having a sound emitting hole 101 and containing a diaphragm 102 having its periphery fixed to the frame 100, a coil 104 having an axis S perpendicular to the diaphragm 102 and attached centrally to the diaphragm 102, and a disk-like magnet 103 located coaxially with the axis S of the coil 104 and magnetized in the direction parallel to the axis. A gap G is formed axially of the coil 104 between the magnet 103 and the coil 104.

In this loudspeaker, a magnetic flux occurs from a surface of the magnet 103 that faces the diaphragm 102, as indicated by broken lines in FIG. 35. The magnetic flux acts on the coil 104 through the gap G. Supplying a driving current to the coil 104 in this state drives the diaphragm 102, which then vibrates axially of the coil 104.

There have been proposed other thin loudspeakers having a similar structure (JP 3208310, B, JP 2005-223720, A). In such thin loudspeakers, the coil has a flat shape where it is wound more in the direction perpendicular to the axis than in the axial direction. This allows making the loudspeakers thinner than those shown in FIG. 31 to FIG. 34.

However, the thin loudspeaker as shown in FIG. 35 still has a problem in that there is an increasing effect on sound pressure drop as it is made smaller/thinner. This is because only a magnetic flux component of the magnetic flux generated from the magnet that is perpendicular to the axis of the coil acts as a driving force for the coil, and a magnetic flux component that is parallel to the axis of the coil does not contribute as a coil driving force.

SUMMARY OF THE INVENTION

Accordingly, an object of the present invention is to provide an electroacoustic transducer capable of providing a sufficient sound pressure even when it is made smaller/thinner.

An electroacoustic transducer of the present invention includes a diaphragm 3 having a periphery as a fixed end, a coil 4 having an axis perpendicular to the diaphragm 3 and attached centrally to the diaphragm 3, and a direct current magnetic field generator fixed in position as spaced apart from the coil 4 by a gap provided axially of the coil 4. The diaphragm 3 is driven by applying to the coil 4 a magnetic flux emitted from the direct current magnetic field generator.

In a first electroacoustic transducer of the present invention, the direct current magnetic field generator includes a ring-shaped outer magnet 5 located coaxially with the axis of the coil 4 and magnetized in the direction perpendicular to the axis, and an inner core 6 including a ferromagnet and located in the central hole of the outer magnet 5.

In the above electroacoustic transducer of the present invention, magnetic flux loops are formed around the coil 4 facing, front face, and the opposite, rear face of the outer magnet 5, each describing a loop on a cross section including the central axis of the outer magnet 5. The magnetic flux loops around the front face of the outer magnet 5 are attracted toward the inner core 6 and expand in the direction parallel to the front face of the outer magnet 5 to be an elliptic loop having a major axis parallel to the front face of the outer magnet 5 and a minor axis perpendicular to the front face of the outer magnet 5 because the inner core 6, including a ferromagnet, is located in the central hole of the outer magnet 5. Such elliptic magnetic flux loops penetrate the coil 4, and therefore many of the magnetic fluxes that pass through the coil 4 extend in the direction perpendicular to the axis between the inner peripheral surface and outer peripheral surface of the coil 4, so that the magnetic flux horizontal component, in the direction perpendicular to the axis, will act on a large part of the winding of the coil 4. This results in a great driving force acting on the diaphragm 3, providing a great sound pressure.

In a second electroacoustic transducer of the present invention, the direct current magnetic field generator includes a ring-shaped outer magnet 5 located coaxially with the axis of the coil 4 and magnetized in the direction perpendicular to the axis, and an inner magnet 51 located in the central hole of the outer magnet 5. The inner magnet 51 is magnetized in the direction parallel to the axis of the coil 4, and placed such that the polarity of the outer magnet 5 toward the inner periphery is the same as the polarity of the inner magnet 51 toward the coil 4.

In the above electroacoustic transducer of the present invention, magnetic flux loops are formed around the coil 4 facing, front face, and the opposite, rear face of the outer magnet 5, each describing a loop on a cross section including the central axis of the outer magnet 5. The magnetic flux loops around the front face of the outer magnet 5 have an increased magnetic flux density in combination with a magnetic flux generated from the inner magnet 51, and are attracted toward the inner magnet 51 to be a generally elliptic loop having a major axis approximately parallel to the front face of the outer magnet 5 and a minor axis approximately perpendicular to the front face of the outer magnet 5 because the inner magnet 51, magnetized in the direction parallel to the axis of the coil 4, is located in the central hole of the outer magnet 5. Such generally elliptic magnetic flux loops penetrate the coil 4, and therefore many of the magnetic fluxes that pass through the coil 4 extend in the direction perpendicular to the coil axis between the inner peripheral surface and outer peripheral surface of the coil 4, so that the magnetic flux horizontal component, in the direction perpendicular to the coil axis, will act on a large part of the winding of the coil 4. This results in a great driving force acting on the diaphragm 3, providing a great sound pressure.

Specifically, in the first or second electroacoustic transducer, a distance A between the inner peripheral surface of the outer magnet 5 and the inner peripheral surface of the coil 4 in the direction perpendicular to the axis is arranged to be a half value, or an approximate value thereof, of a width dimension L between the inner peripheral surface and outer peripheral surface of the coil 4 in the direction perpendicular to the axis. According to this specific structure, the magnetic flux loops formed around the front face of the outer magnet 5 act on the coil 4 near the center of its winding existence region with a portion having a maximum magnetic flux horizontal component, and therefore the integral value of the magnetic flux horizontal component to act on the whole coil 4 is maximized.

In a third electroacoustic transducer of the present invention, the direct current magnetic field generator includes a pair of oppositely located outer magnets 7, 7 in the form of a rectangular parallelepiped having therebetween a central axis coaxial with the axis of the coil 41 and magnetized in the direction perpendicular to the axis, and an inner core 8 including a ferromagnet and located between the both outer magnets 7, 7.

In the above electroacoustic transducer of the present invention, magnetic flux loops are formed around the diaphragm 31 facing, front faces, and the opposite, rear faces of the both outer magnets 7, 7, each describing a loop on a cross section perpendicular to the front faces of the outer magnets 7, 7 and including a magnetized direction axis of the outer magnets 7. The magnetic flux loops around the front faces of the outer magnets 7 are attracted toward the inner core 8 and expand in the direction parallel to the front faces of the outer magnets 7 to be an elliptic loop having a major axis parallel to the front faces of the outer magnets 7 and a minor axis perpendicular to the front faces of the outer magnets 7 because the inner core 8, including a ferromagnet, is located between the both outer magnets 7, 7. Such elliptic magnetic flux loops penetrate the coil 41, and therefore many of the magnetic fluxes that pass through the coil 41 extend in the direction perpendicular to the axis between the inner peripheral surface and outer peripheral surface of the coil 41, so that the magnetic flux horizontal component, in the direction perpendicular to the axis, will act on a large part of the winding of the coil 41. This results in a great driving force acting on the diaphragm 31, providing a great sound pressure.

In a fourth electroacoustic transducer of the present invention, the direct current magnetic field generator includes a pair of oppositely located outer magnets 7, 7 in the form of a rectangular parallelepiped having therebetween a central axis coaxial with the axis of the coil 41 and magnetized in the direction perpendicular to the axis, and an inner magnet 71 located between the both outer magnets 7, 7. The inner magnet 71 is magnetized in the direction parallel to the axis of the coil 41, and placed such that the polarity of the both outer magnets 7, 7 toward the inside is the same as the polarity of the inner magnet 71 toward the coil 41.

In the above electroacoustic transducer of the present invention, magnetic flux loops are formed around the front faces and rear faces of the both outer magnets 7, 7, each describing a loop on a cross section perpendicular to the front faces of the outer magnets 7, 7 and including a magnetized direction axis of the outer magnets 7. The magnetic flux loops around the front faces of the outer magnets 7 have an increased magnetic flux density in combination with a magnetic flux generated from the inner magnet 71, and are attracted toward the inner magnet 71 to be a generally elliptic loop having a major axis approximately parallel to the front faces of the outer magnets 7 and a minor axis approximately perpendicular to the front faces of the outer magnets 7 because the inner magnet 71, magnetized in the direction parallel to the axis of the coil 41, is located between the both outer magnets 7, 7. Such generally elliptic magnetic flux loops penetrate the coil 41, and therefore many of the magnetic fluxes that pass through the coil 41 extend in the direction perpendicular to the coil axis between the inner peripheral surface and outer peripheral surface of the coil 41, so that the magnetic flux horizontal component, in the direction perpendicular to the coil axis, will act on a large part of the winding of the coil 41. This results in a great driving force acting on the diaphragm 31, providing a great sound pressure.

Specifically, in the third or fourth electroacoustic transducer, a distance A between the inner side surface of the outer magnet 7 and the inner peripheral surface of the coil 41 in the direction perpendicular to the axis is arranged to be a half value, or an approximate value thereof, of a width dimension L between the inner peripheral surface and outer peripheral surface of the coil 41 in the direction perpendicular to the axis.

According to this specific structure, the magnetic flux loops formed around the front face of the outer magnet 7 act on the coil 41 near the center of its winding existence region with a portion having a maximum magnetic flux horizontal component, and therefore the integral value of the magnetic flux horizontal component to act on the whole coil 41 is maximized.

As described above, in the electroacoustic transducer of the present invention, the coil can be made flatter by being wound in the plane direction of the diaphragm. In addition, the device can be made thinner as a whole, and also provide a sufficient sound pressure even when it is made smaller/thinner, because a high-density magnetic flux horizontal component can be applied to the coil.

DETAILED DESCRIPTION OF THE INVENTION

Embodiments of the present invention will be specifically described below with reference to the drawings.

First Embodiment

Figure 1:
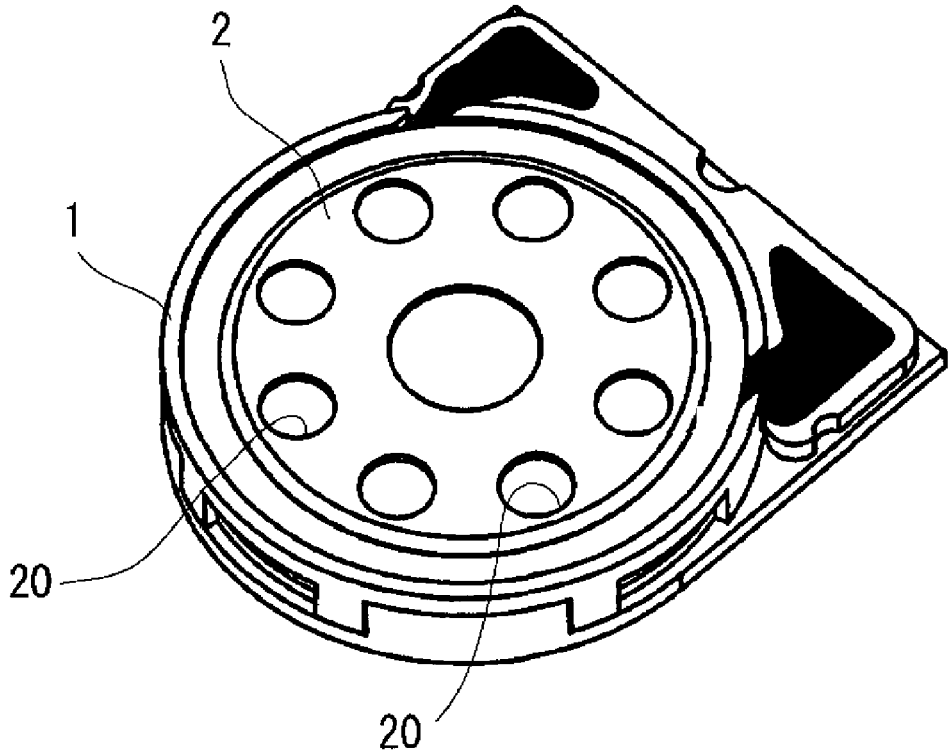
FIG. 1 is a perspective view showing an appearance of a circular electroacoustic transducer of the present invention.
Figure 2:
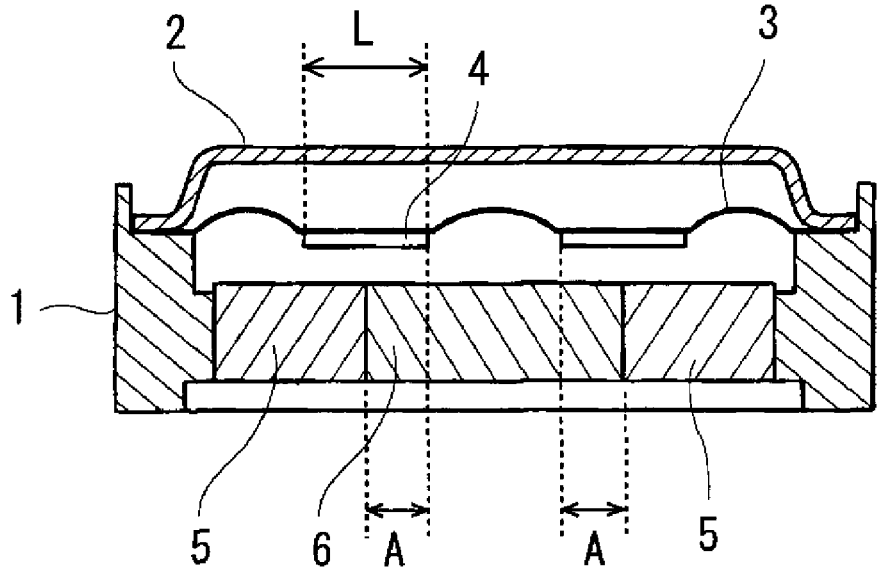
FIG. 2 is a sectional view of the electroacoustic transducer.

FIG. 1 and FIG. 2 show an electroacoustic transducer of a first embodiment of the present invention, which includes a flat cylindrical frame 1 and a disk-like cover 2 having a plurality of sound emitting holes 20 and attached to the front opening of the frame 1.

As illustrated in FIG. 2, a disk-like diaphragm 3 is arranged inside the frame 1. The diaphragm 3 is pinched at its periphery between the frame 1 and the cover 2. A flat coil 4 is wound about an axis S on the diaphragm 3 and fixed to the rear face of the diaphragm 3. A ring-shaped outer magnet 5 is fixed inside the frame 1, as spaced apart from the coil 4 by a predetermined gap. A disk-like inner core 6 formed from a ferromagnet such as iron or permalloy is arranged in the central hole of the outer magnet S.

Figure 3:
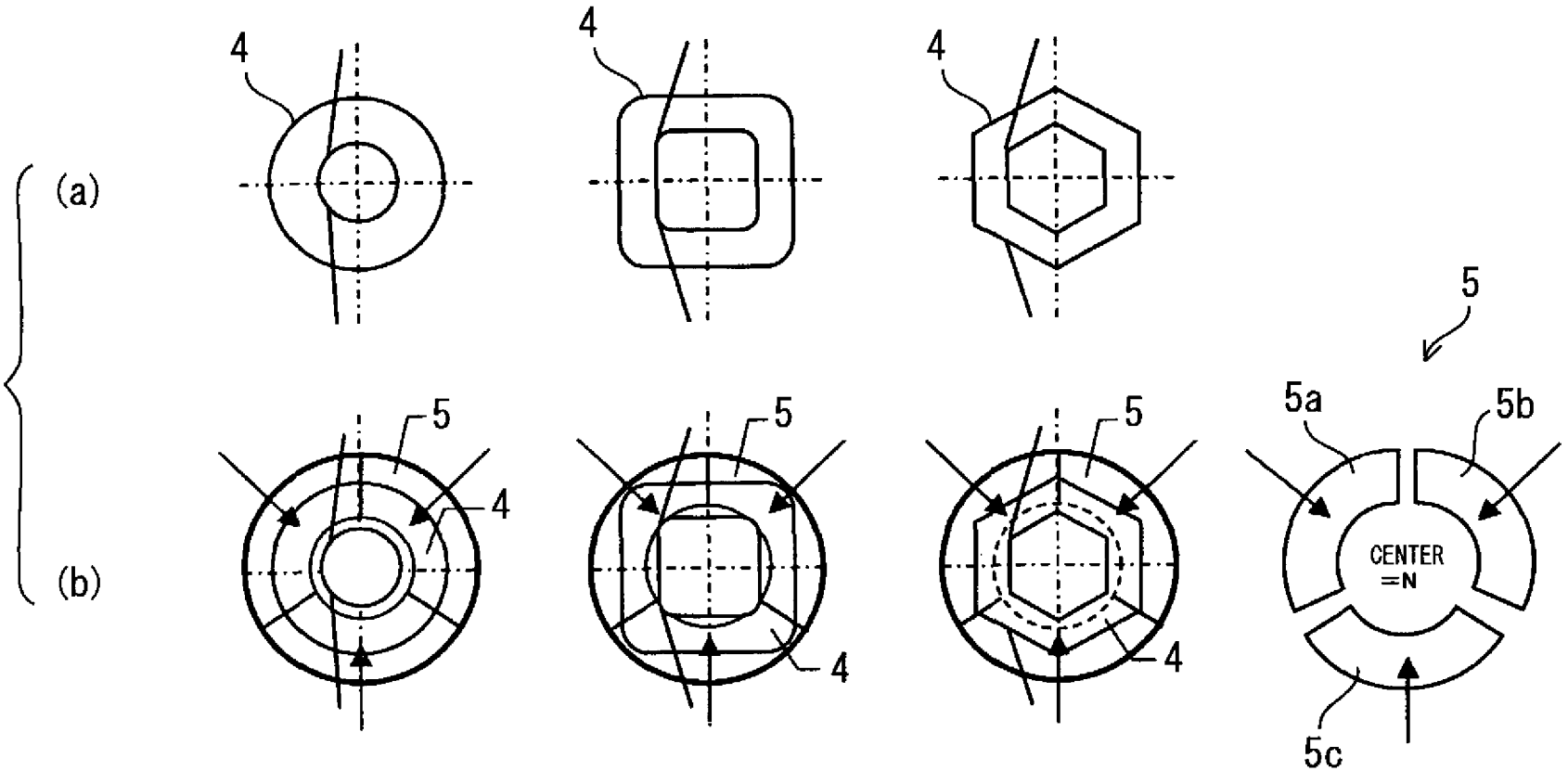
FIG. 3 illustrates plan views showing various coil shapes and a positional relationship with an outer magnet in the electroacoustic transducer.

The coil 4 has, for example, a circular, quadrangular, or hexagonal planar shape as shown in FIG. 3(*a*). As illustrated in FIG. 3(*b*), the outer magnet 5 is located coaxially with the axis of the coil 4. The coil 4 is sized such that the winding existence region, between its inner peripheral surface and outer peripheral surface, overlaps with the inner peripheral surface of the outer magnet 5. The outer magnet 5 includes a plurality of fan-shaped magnet pieces 5*a*, 5*b*, 5*c* combined together. The magnet pieces 5*a*, 5*b*, 5*c* are each radially magnetized.

More specifically, as shown in FIG. 2, the distance A between the inner peripheral surface of the outer magnet 5 and the inner peripheral surface of the coil 4 in the direction perpendicular to the axis is arranged to be a half value, or an approximate value thereof, of the width dimension L between 3 the inner peripheral surface and outer peripheral surface of the coil 4 in the direction perpendicular to the axis. The peripheral surface of the inner core 6 is in close contact with, or slightly spaced apart from, the inner peripheral surface of the outer magnet 5.

Figure 4:
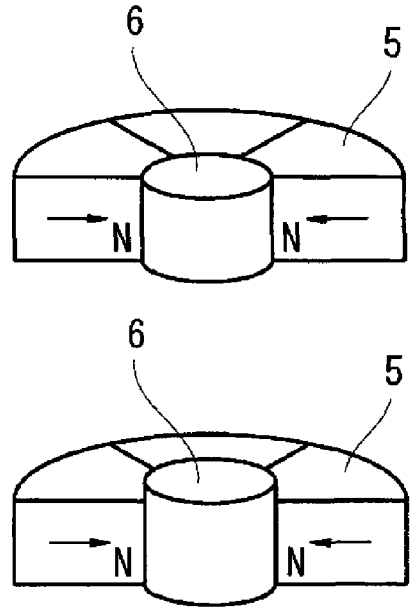
FIG. 4 illustrates partially broken perspective views showing examples of a direct current magnetic field generator in the electroacoustic transducer.
Figure 10:
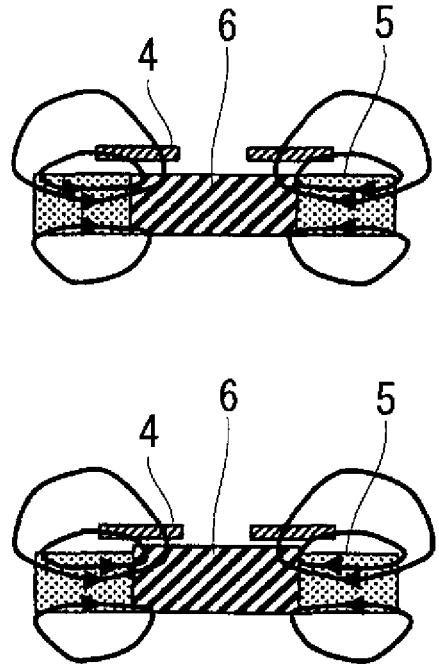
FIG. 10 illustrates sectional views showing magnetic flux loops formed by the direct current magnetic field generator in the electroacoustic transducer.

The outer magnet 5 is magnetized radially as indicated by arrows in FIG. 4 (*a*). The lines of magnetic force emitted from the outer magnet 5 describe loops around the front face and rear face of the outer magnet 5, as shown in FIG. 10(*a*), with the magnetic flux loops around the front face acting on the coil 4.

The magnetic flux loops around the front face of the outer magnet 5 are attracted toward the inner core 6 to be an elliptic loop having a major axis parallel to the front face of the outer magnet 5 and a minor axis perpendicular to the front face of the outer magnet 5 because the inner core 6, including a ferromagnet, is located in the central hole of the outer magnet 5. Such elliptic magnetic flux loops penetrate the coil 4, and therefore many of the magnetic fluxes that pass through the coil 4 extend in the direction perpendicular to the axis between the inner peripheral surface and outer peripheral surface of the coil 4, so that the magnetic flux horizontal component, in the direction perpendicular to the axis, will act on a large part of the winding of the coil 4.

The magnetic flux loops formed around the front face of the outer magnet 5 act on the coil 4 near the center of its winding existence region with a portion having a maximum magnetic flux horizontal component because the distance A between the inner peripheral surface of the outer magnet 5 and the inner peripheral surface of the coil 4 is arranged to be a half value, or an approximate value thereof, of the width dimension L of the coil 4. The integral value of the magnetic flux horizontal component to act on the whole coil 4 is therefore maximized. This results in a great driving force acting on the diaphragm 3, providing a great sound pressure.

As shown in FIG. 4(*b*), the front face of the inner core 6 may protrude toward the coil beyond the front face of the outer magnet 5. With this structure, magnetic flux loops as shown in FIG. 10(*b*) are formed, so that a higher-density magnetic flux can be applied to the coil 4.

Figure 5:
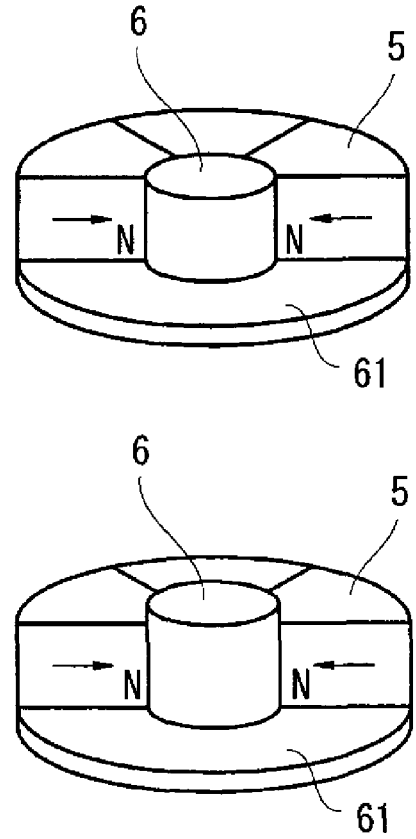
FIG. 5 illustrates partially broken perspective views showing other examples of the direct current magnetic field generator.
Figure 11:
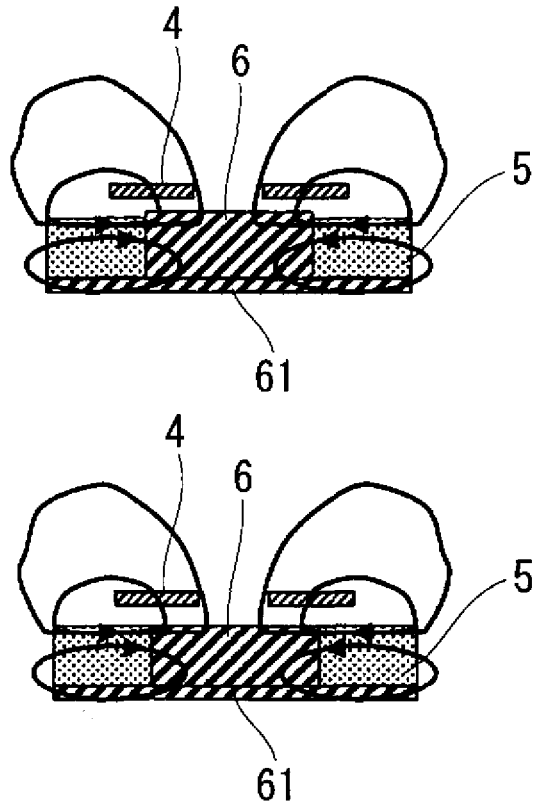
FIG. 11 illustrates sectional views showing magnetic flux loops formed by other direct current magnetic field generators.

It is also possible to employ a structure, as shown in FIG. 5(*a*), having a disk-like bottom core 61 formed from a ferromagnet such as iron or permalloy and arranged on the rear face of the inner core 6 and outer magnet 5, or the structure as described above wherein, as shown in FIG. 5(*b*), the front face of the inner core 6 protrudes toward the coil beyond the front face of the outer magnet 5. The bottom core 61 may be a part of, or a separate component from, the inner core 6. With these structures, the magnetic flux loops around the rear face of the outer magnet 5 pass through the bottom core 61 as shown in FIGS. 11(*a*), (*b*), and cause magnetic saturation at the bottom core 61. This increases magnetic flux loops around the front face of the outer magnet 5, so that more magnetic fluxes can be applied to the coil 4.

Second Embodiment

Figure 6:
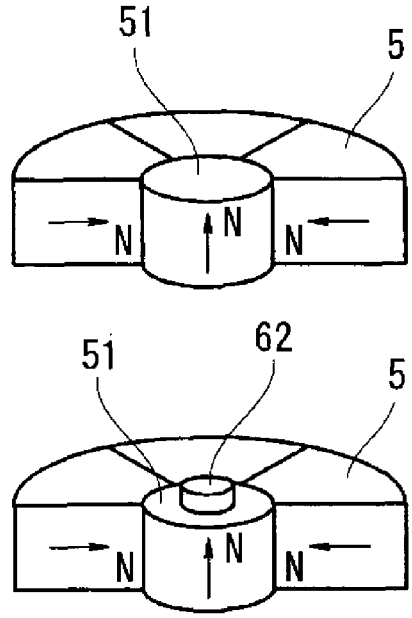
FIG. 6 illustrates partially broken perspective views showing other examples of the direct current magnetic field generator.

An electroacoustic transducer of a second embodiment of the present invention has the same structure as the electroacoustic transducer of the first embodiment, except that, as shown in FIG. 6(*a*), a columnar inner magnet 51 is arranged in the central hole of the outer magnet 5.

Figure 12:
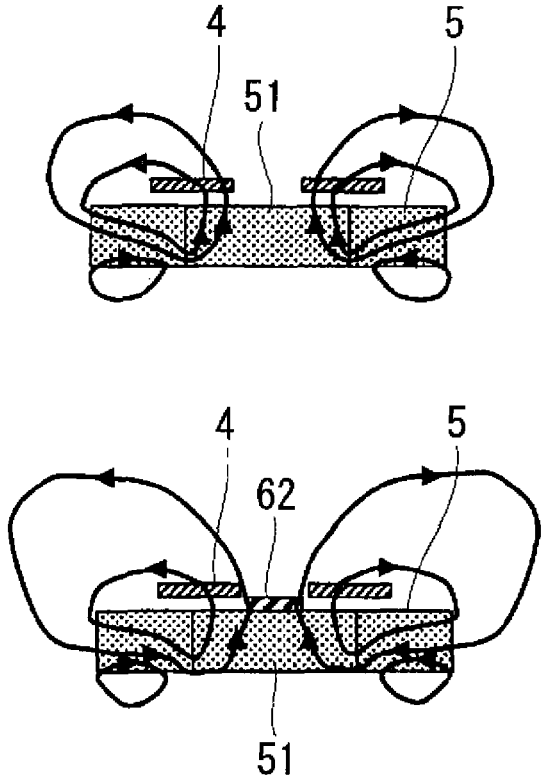
FIG. 12 illustrates sectional views showing magnetic flux loops formed by other direct current magnetic field generators.

The inner magnet 51 is magnetized axially as shown in FIG. 6(*a*), and placed such that the polarity of the outer magnet 5 toward the inner periphery is the same as the polarity of the inner magnet 51 toward the coil 4. The lines of magnetic force emitted from the outer magnet 5 and the inner magnet 51 describe loops around the front face and rear face of the outer magnet 5, as shown in FIG. 12(*a*), with the magnetic flux loops around the front face acting on the coil 4.

The magnetic flux loops around the front face of the outer magnet 5 have an increased magnetic flux density in combination with a magnetic flux generated from the inner magnet 51 because the inner magnet 51, magnetized axially, is located in the central hole of the outer magnet 5. Many of the magnetic fluxes describe loops around the front face of the outer magnet 5, the magnetic flux loops around the front face being a generally elliptic loop having a major axis approximately parallel to the front face of the outer magnet 5 and a minor axis approximately perpendicular to the front face of the outer magnet 5. Such generally elliptic magnetic flux loops penetrate the coil 4, and therefore many of the magnetic fluxes that pass through the coil 4 extend in the direction perpendicular to the axis between the inner peripheral surface and outer peripheral surface of the coil 4, so that the magnetic flux horizontal component, in the direction perpendicular to the coil axis, will act on a large part of the winding of the coil 4.

As in the first embodiment, the magnetic flux loops formed around the front face of the outer magnet 5 act on the coil 4 near the center of its winding existence region with a portion having a maximum magnetic flux horizontal component because the distance A between the inner peripheral surface of the outer magnet 5 and the inner peripheral surface of the coil 4 is arranged to be a half value, or an approximate value thereof, of the width dimension L of the coil 4. The integral value of the magnetic flux horizontal component to act on the whole coil 4 is therefore maximized. This results in a great driving force acting on the diaphragm 3, providing a great sound pressure.

As shown in FIG. 6(*b*), a top core 62 formed from a ferromagnet such as iron or permalloy may be arranged on the front face of the inner magnet 51. With this structure, the magnetic flux loops are attracted toward the top core 62 as shown in FIG. 12(*b*), so that more magnetic fluxes can be applied to the coil 4.

Figure 7:
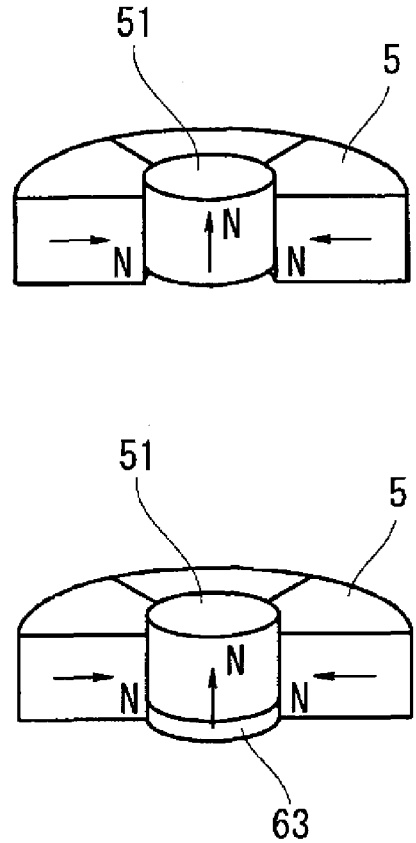
FIG. 7 illustrates partially broken perspective views showing other examples of the direct current magnetic field generator.
Figure 13:
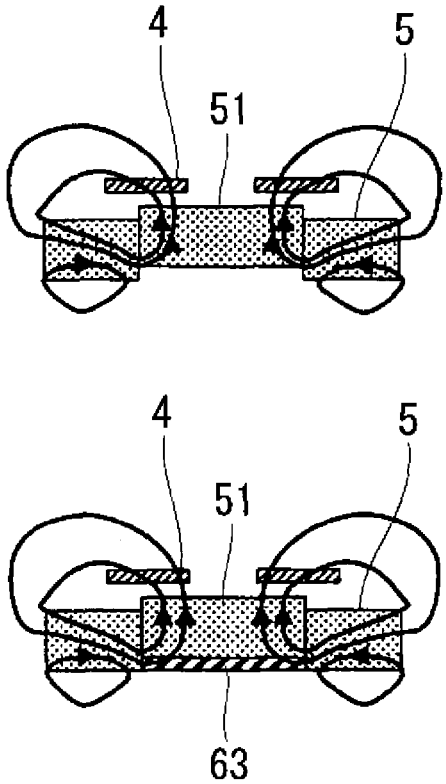
FIG. 13 illustrates sectional views showing magnetic flux loops formed by other direct current magnetic field generators.

It is also possible to employ a structure wherein, as shown in FIG. 7(*a*), the inner magnet 51 is shifted toward the coil 4, so that the front face of the inner magnet 51 protrudes toward the coil 4 beyond the front face of the outer magnet 5, and that the rear face of the inner magnet 51 is depressed from the rear face of the outer magnet 5, or the structure as described above wherein a disk-like bottom core 63 formed from a ferromagnet such as iron or permalloy is arranged on the rear face of the inner magnet 51. With these structures, the magnetic flux loops are attracted toward the coil 4 as shown in FIGS. 13(*a*), (*b*), so that more magnetic fluxes can be applied to the coil 4. Especially in the case of FIG. 13(*b*), the magnetic flux through the bottom core 63 causes magnetic saturation, which will in turn increase magnetic fluxes around the front face of the outer magnet 5.

Figure 8:
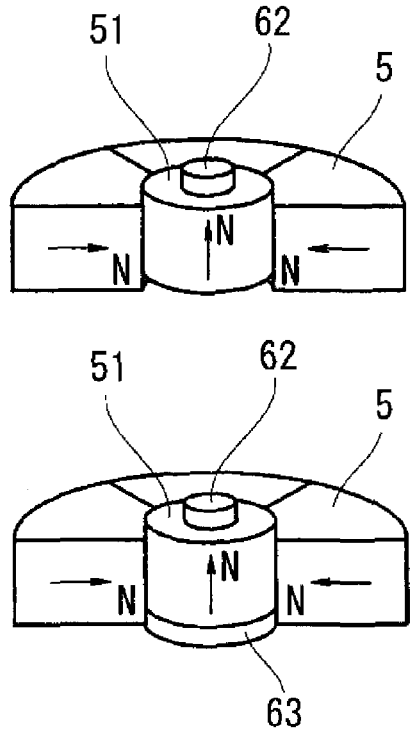
FIG. 8 illustrates partially broken perspective views showing other examples of the direct current magnetic field generator.
Figure 14:
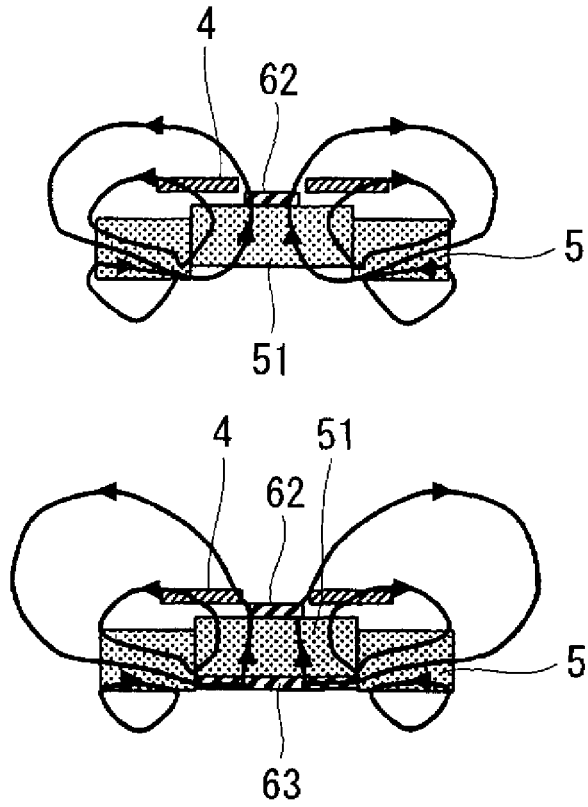
FIG. 14 illustrates sectional views showing magnetic flux loops formed by other direct current magnetic field generators.

It is also possible to employ the structure shown in FIG. 7(*a*) wherein, as shown in FIG. 8(*a*), a disk-like top core 62 formed from a ferromagnet such as iron or permalloy is arranged on the front face of the inner magnet 51, and it is also possible to employ the structure as described above wherein, as shown in FIG. 8(*b*), a disk-like bottom core 63 formed from a ferromagnet such as iron or permalloy is arranged on the rear face of the inner magnet 51. With these structures, magnetic flux loops through the top core 62 as shown in FIGS. 14(*a*), (*b*) are formed, whereby the magnetic flux loops through the coil 4 have a large distribution of the horizontal magnetic flux component, so that the horizontal magnetic flux component can be applied across the coil 4 through the inner periphery and the outer periphery. Especially in the case of FIG. 14(*b*), the magnetic flux through the bottom core 63 causes magnetic saturation, which will in turn increase magnetic fluxes around the front face of the outer magnet 5.

Figure 9:
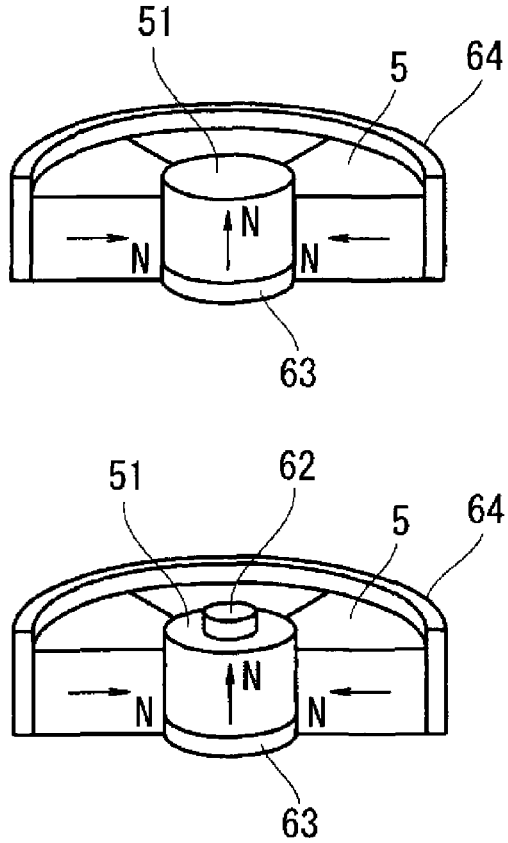
FIG. 9 illustrates partially broken perspective views showing other examples of the direct current magnetic field generator.
Figure 15:
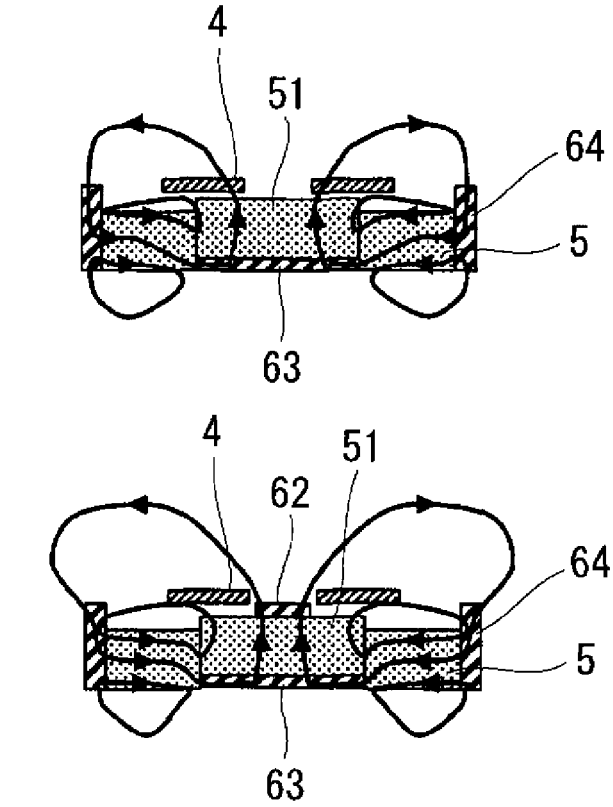
FIG. 15 illustrates sectional views showing magnetic flux loops formed by other direct current magnetic field generators.

Further, in the structure shown in FIG. 7(*b*), a cylindrical side core 64, as shown in FIG. 9(*a*), formed from a ferromagnet such as iron or permalloy may be arranged on the outer peripheral surface of the outer magnet 5 in such a manner to protrude toward the coil 4 beyond the front face of the outer magnet 5. With this structure, magnetic flux loops through the bottom core 63 and side core 64 as shown in FIG. 15(*a*) are formed, whereby the magnetic flux loops are attracted toward the coil 4, so that more magnetic fluxes can be applied to the coil 4.

Further, in the structure shown in FIG. 9(*a*), a disk-like top core 62, as shown in FIG. 9(*b*), formed from a ferromagnet such as iron or permalloy may be arranged on the front face of the inner magnet 51. With this structure, magnetic flux loops through the bottom core 63, side core 64 and top core 62 as shown in FIG. 15(*b*) are formed, whereby the magnetic flux loops are attracted toward the coil 4, so that more magnetic fluxes can be applied to the coil 4. Especially the lines of magnetic force between the top core 62 and the side core 64 are changed in direction to be perpendicular to the axis of the coil 4, so that an increased magnetic flux horizontal component can be applied to the coil 4.

Third Embodiment

Figure 16:
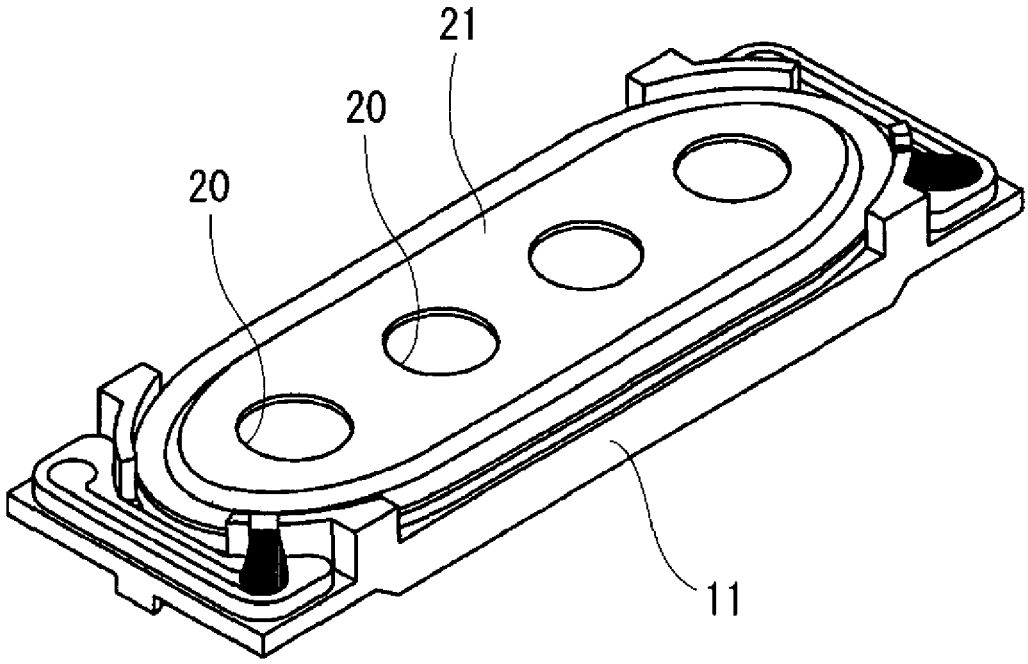
FIG. 16 is a perspective view showing an appearance of an oval electroacoustic transducer of the present invention.
Figure 17:
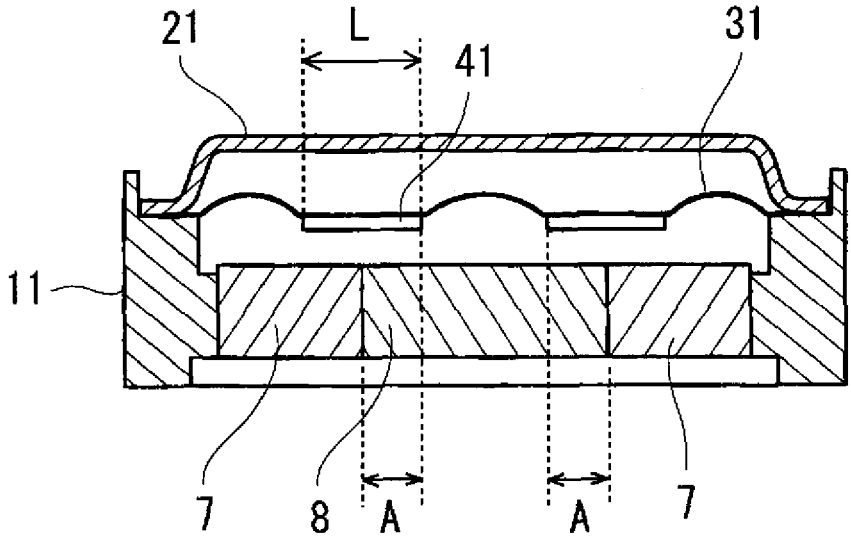
FIG. 17 is a sectional view along the short axis of the electroacoustic transducer.

FIG. 16 and FIG. 17 show an electroacoustic transducer of a third embodiment of the present invention, which includes a flat cylindrical frame 11 having an oval or elliptic planar shape, and a cover 21 having an oval or elliptic planar shape having a plurality of sound emitting holes 20 and attached to the front opening of the frame 11.

As illustrated in FIG. 17, a diaphragm 31 having an oval or elliptic planar shape is arranged inside the frame 11. The diaphragm 31 is pinched at its periphery between the frame 11 and the cover 21. A flat coil 41 is wound about an axis S on the diaphragm 31 and fixed to the rear face of the diaphragm 31. A pair of outer magnets 7, 7 in the form of a rectangular parallelepiped are fixed inside the frame 11, as spaced apart from the coil 41 by a predetermined gap. An inner core 8 in the form of a rectangular parallelepiped formed from a ferromagnet such as iron or permalloy is arranged between the both outer magnets 7, 7.

Figure 18:
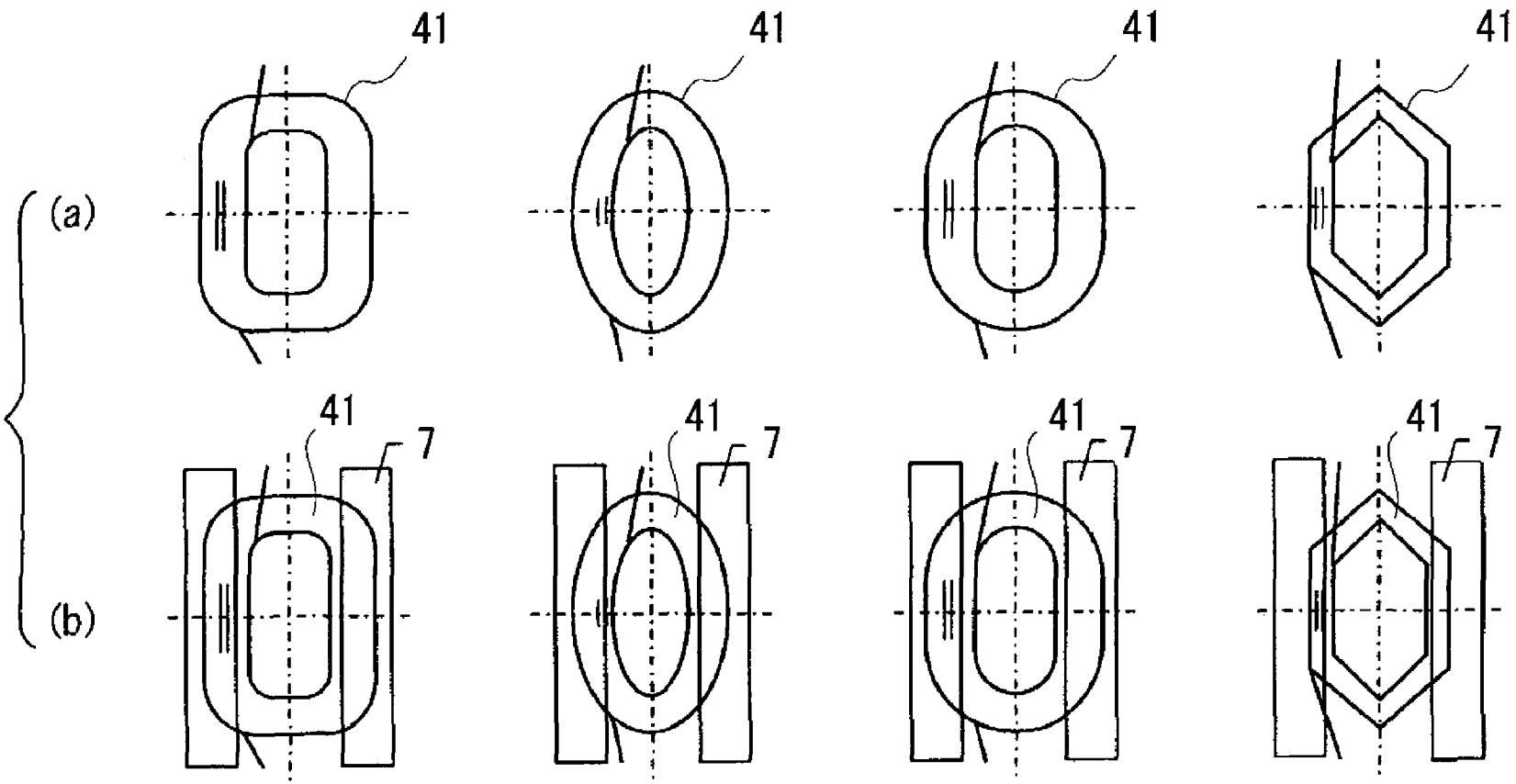
FIG. 18 illustrates plan views showing various coil shapes and a positional relationship with outer magnets in the electroacoustic transducer.

The coil 41 has a planar shape in the form of, for example, an oblong rectangular, ellipse, track, or hexagon, as shown in FIG. 18(*a*). As illustrated in FIG. 18(*b*), the pair of outer magnets 7, 7 are oppositely located with the axis of the coil 41 interposed therebetween. The coil 41 is sized such that the winding existence region, between its inner peripheral surface and outer peripheral surface, overlaps with the inner side surfaces (inner surfaces) of the both outer magnets 7, 7.

More specifically, as shown in FIG. 17, the distance A between the inner surface of the outer magnet 7 and the inner peripheral surface of the coil 41 in the direction perpendicular to the axis is arranged to be a half value, or an approximate value thereof, of the width dimension L between the inner peripheral surface and outer peripheral surface of the coil 41 in the direction perpendicular to the axis. The opposite side surfaces of the inner core 8 are in close contact with, or slightly spaced apart from, the inner surfaces of the outer magnets 7, 7.

Figure 19:
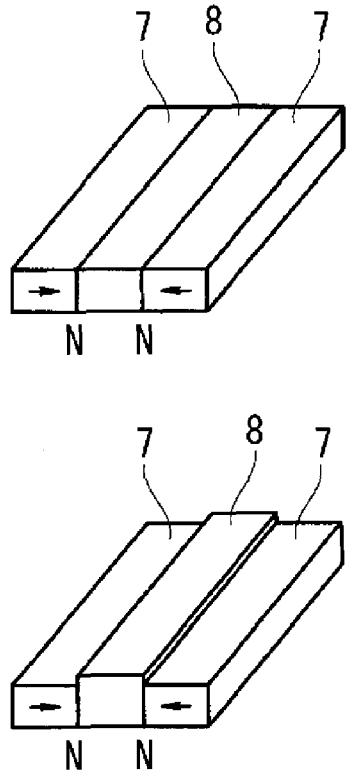
FIG. 19 illustrates perspective views showing examples of a direct current magnetic field generator in the electroacoustic transducer.
Figure 25:
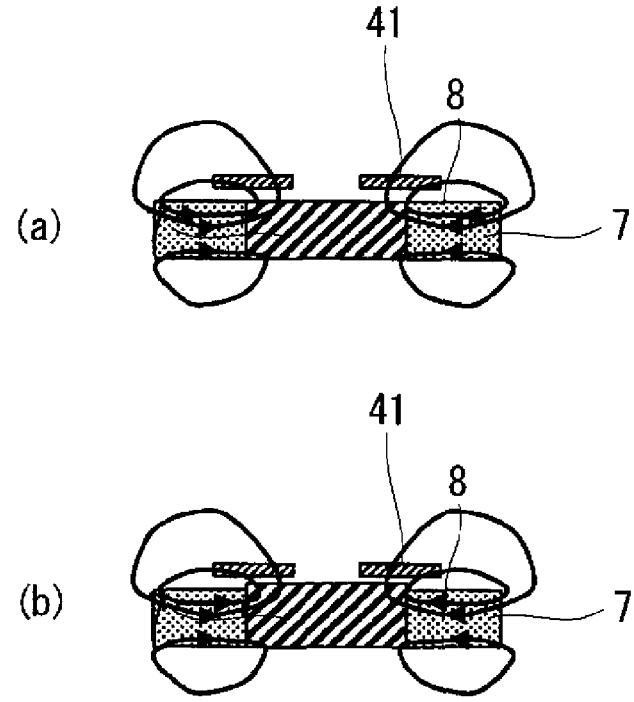
FIG. 25 illustrates sectional views showing magnetic flux loops formed by the direct current magnetic field generator in the electroacoustic transducer.

The outer magnets 7, 7 are oppositely magnetized in the direction perpendicular to the axis of the coil, as indicated by arrows in FIG. 19(*a*). The lines of magnetic force emitted from the outer magnets 7, 7 describe loops around the front faces and rear faces of the outer magnets 7, as shown in FIG. 25(*a*), with the magnetic flux loops around the front faces acting on the coil 41.

The magnetic flux loops around the front faces of the outer magnets 7 are attracted toward the inner core 8 to be an elliptic loop having a major axis parallel to the front faces of the outer magnets 7 and a minor axis perpendicular to the front faces of the outer magnets 7 because the inner core 8, including a ferromagnet, is located between the both outer magnets 7, 7. Such elliptic magnetic flux loops penetrate the coil 41, and therefore many of the magnetic fluxes that pass through the coil 41 extend in the direction perpendicular to the axis between the inner peripheral surface and outer peripheral surface of the coil 41, so that the magnetic flux horizontal component, in the direction perpendicular to the axis, will act on a large part of the winding of the coil 41.

The magnetic flux loops formed around the front face of the outer magnet 7 act on the coil 41 near the center of its winding existence region with a portion having a maximum magnetic flux horizontal component because the distance A between the inner surface of the outer magnet 7 and the inner peripheral surface of the coil 41 is arranged to be a half value, or an approximate value thereof, of the width dimension L of the coil 41. The integral value of the magnetic flux horizontal component to act on the whole coil 41 is therefore maximized. This results in a great driving force acting on the diaphragm 31, providing a great sound pressure.

As shown in FIG. 19(*b*), the front face of the inner core 8 may protrude toward the coil beyond the front faces of the outer magnets 7, 7. With this structure, magnetic flux loops as shown in FIG. 25(*b*) are formed, so that a higher-density magnetic flux can be applied to the coil 41.

Figure 20:
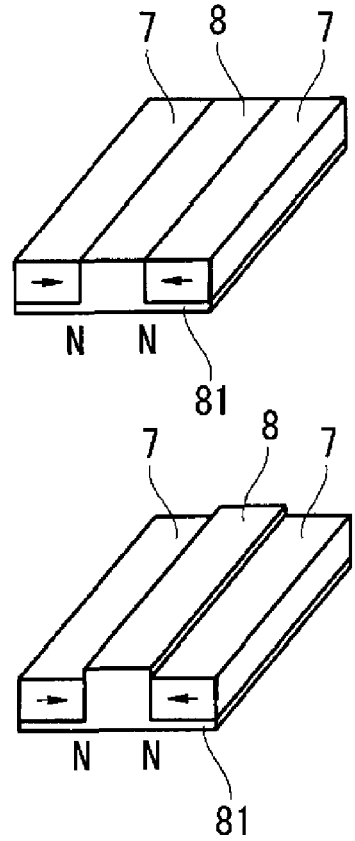
FIG. 20 illustrates perspective views showing other examples of the direct current magnetic field generator.
Figure 26:
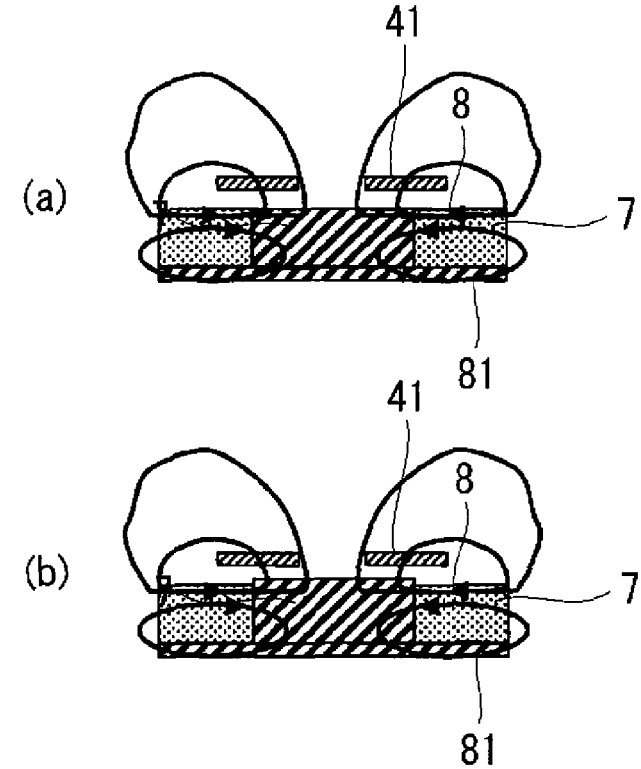
FIG. 26 illustrates sectional views showing magnetic flux loops formed by other direct current magnetic field generators.

It is also possible to employ a structure, as shown in FIG. 20(*a*), having a tabular bottom core 81 formed from a ferromagnet such as iron or permalloy and arranged on the rear face of the inner core 8 and outer magnets 7, 7, or the structure as described above wherein, as shown in FIG. 20(*b*), the front face of the inner core 8 protrudes toward the coil beyond the front faces of the outer magnets 7, 7. The bottom core 81 may be a part of, or a separate component from, the inner core 8. With these structures, the magnetic flux loops around the rear faces of the outer magnets 7 pass through the bottom core 81 as shown in FIGS. 26(*a*), (*b*), and cause magnetic saturation at the bottom core 81. This increases magnetic flux loops around the front faces of the outer magnets 7, so that more magnetic fluxes can be applied to the coil 41.

Fourth Embodiment

Figure 21:
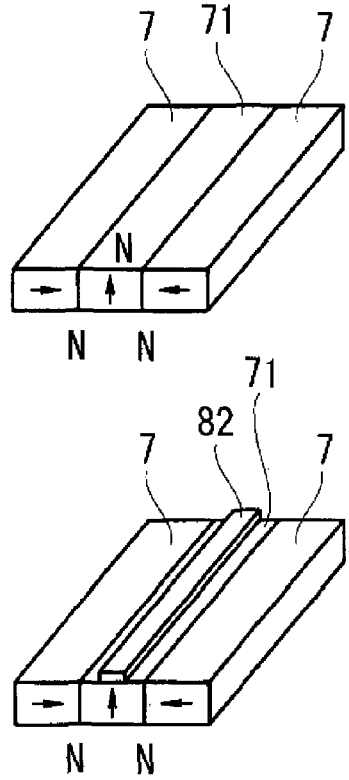
FIG. 21 illustrates perspective views showing other examples of the direct current magnetic field generator.

An electroacoustic transducer of a fourth embodiment of the present invention has the same structure as the electroacoustic transducer of the third embodiment, except that, as shown in FIG. 21(*a*), an inner magnet 71 in the form of a rectangular parallelepiped is arranged between the both outer magnets 7, 7.

Figure 27:
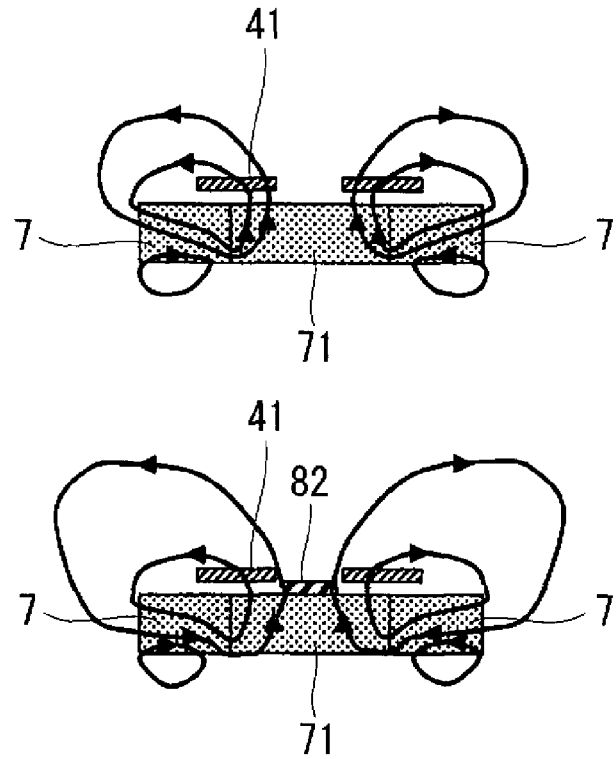
FIG. 27 illustrates sectional views showing magnetic flux loops formed by other direct current magnetic field generators.

The inner magnet 71 is magnetized in the direction parallel to the axis of the coil 41, as shown in FIG. 21(*a*), and placed such that the polarity of the both outer magnets 7, 7 toward the inside is the same as the polarity of the inner magnet 71 toward the coil 41. The lines of magnetic force emitted from the inner magnet 71 and the both outer magnets 7, 7 describe loops around the front faces and rear faces of the both outer magnets 7, 7, as shown in FIG. 27(*a*), with the magnetic flux loops around the front faces acting on the coil 41.

The magnetic flux loops around the front faces of the outer magnets 7 have an increased magnetic flux density in combination with a magnetic flux generated from the inner magnet 71 because the inner magnet 71, magnetized axially of the coil 41, is located between the both outer magnets 7, 7. Many of the magnetic fluxes describe loops around the front faces of the outer magnets 7, the magnetic flux loops around the front faces being a generally elliptic loop having a major axis approximately parallel to the front faces of the outer magnets 7 and a minor axis approximately perpendicular to the front faces of the outer magnets 7. Such generally elliptic magnetic flux loops penetrate the coil 41, and therefore many of the magnetic fluxes that pass through the coil 41 extend in the direction perpendicular to the axis between the inner peripheral surface and outer peripheral surface of the coil 41, so that the magnetic flux horizontal component, in the direction perpendicular to the axis, will act on a large part of the winding of the coil 41.

As in the third embodiment, the magnetic flux loops formed around the front faces of the outer magnets 7, 7 act on the coil 41 near the center of its winding existence region with a portion having a maximum magnetic flux horizontal component because the distance A between the inner surface of the outer magnets 7, 7 and the inner peripheral surface of the coil 41 is arranged to be a half value, or an approximate value thereof, of the width dimension L of the coil 41. The integral value of the magnetic flux horizontal component to act on the whole coil 41 is therefore maximized. This results in a great driving force acting on the diaphragm 31, providing a great sound pressure.

As shown in FIG. 21(*b*), a strip-like top core 82 formed from a ferromagnet such as iron or permalloy may be arranged on the front face of the inner magnet 71. With this structure, the magnetic flux loops are attracted toward the top core 82 as shown in FIG. 27(*b*), so that more magnetic fluxes can be applied to the coil 41.

Figure 22:
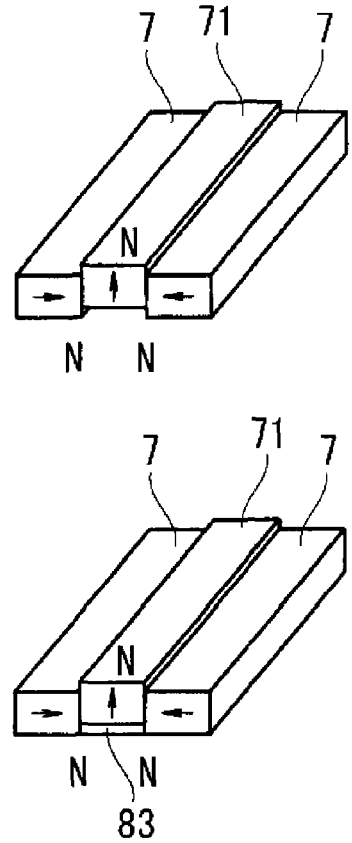
FIG. 22 illustrates perspective views showing other examples of the direct current magnetic field generator.
Figure 28:
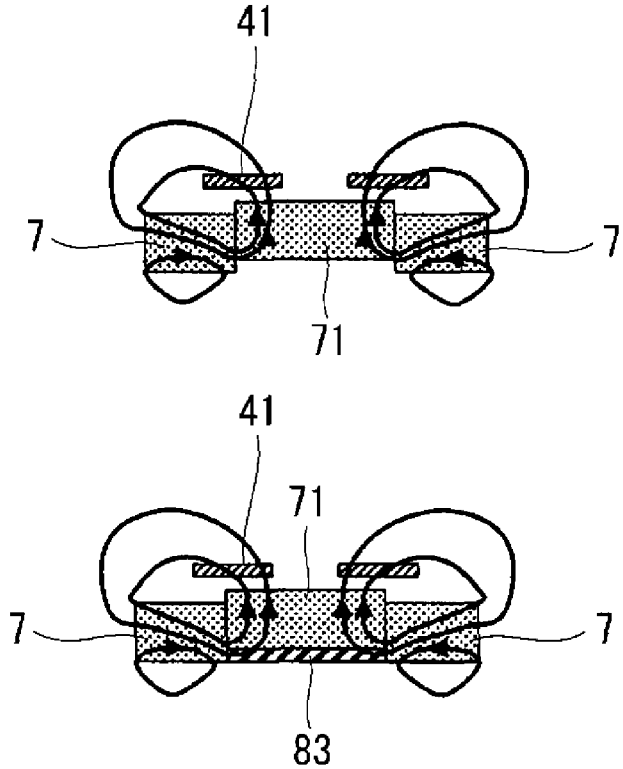
FIG. 28 illustrates sectional views showing magnetic flux loops formed by other direct current magnetic field generators.

It is also possible to employ a structure wherein, as shown in FIG. 22(*a*), the inner magnet 71 is shifted toward the coil 41, so that the front face of the inner magnet 71 protrudes toward the coil 41 beyond the front faces of the outer magnets 7, 7, and that the rear face of the inner magnet 71 is depressed from the rear faces of the outer magnets 7, 7, or the structure as described above wherein a strip-like bottom core 83 formed from a ferromagnet such as iron or permalloy is arranged on the rear face of the inner magnet 71. With these structures, the magnetic flux loops are attracted toward the coil 41 as shown in FIG. 28(*a*), (*b*), so that more magnetic fluxes can be applied to the coil 41. Especially in the case of FIG. 28(*b*), the magnetic flux through the bottom core 83 causes magnetic saturation, which will in turn increase magnetic fluxes around the front faces of the outer magnets 7.

Figure 23:
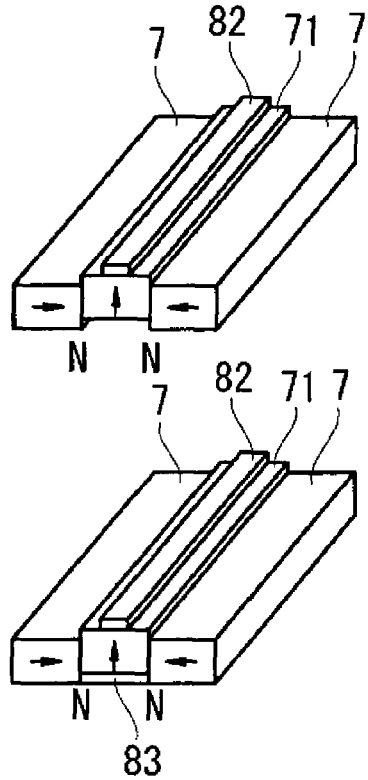
FIG. 23 illustrates perspective views showing other examples of the direct current magnetic field generator.
Figure 29:
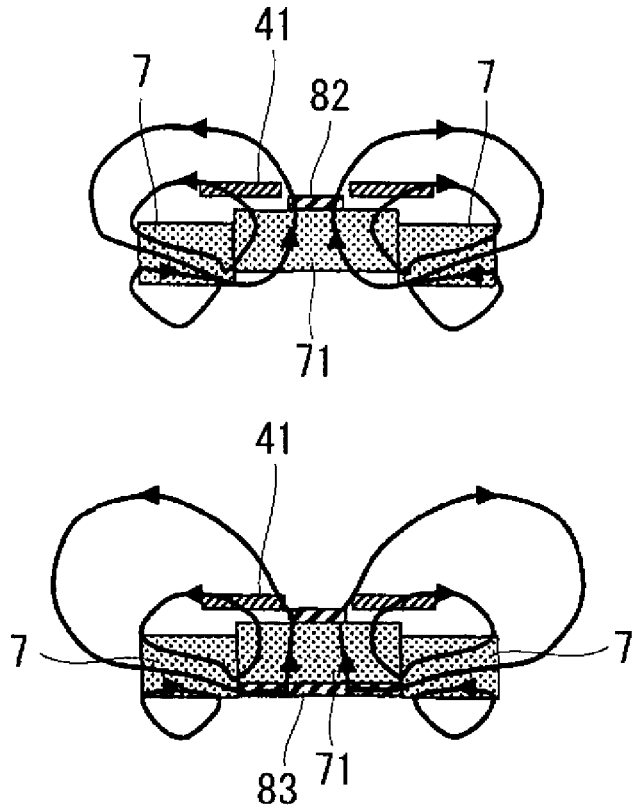
FIG. 29 illustrates sectional views showing magnetic flux loops formed by other direct current magnetic field generators.

It is also possible to employ the structure shown in FIG. 22(*a*) wherein, as shown in FIG. 23(*a*), a strip-like top core 82 formed from a ferromagnet such as iron or permalloy is arranged on the front face of the inner magnet 71, and it is also possible to employ the structure as described above wherein, as shown in FIG. 23(*b*), a strip-like bottom core 83 formed from a ferromagnet such as iron or permalloy is arranged on the rear face of the inner magnet 71. With these structures, magnetic flux loops through the top core 82 as shown in FIGS. 29(*a*), (*b*) are formed, whereby the magnetic flux loops through the coil 41 have a large distribution of the horizontal magnetic flux component, so that the horizontal magnetic flux component can be applied across the coil 41 through the inner periphery and the outer periphery. Especially in the case of FIG. 29(*b*), the magnetic flux through the bottom core 83 causes magnetic saturation, which will in turn increase magnetic fluxes around the front faces of the outer magnets 7.

Figure 24:
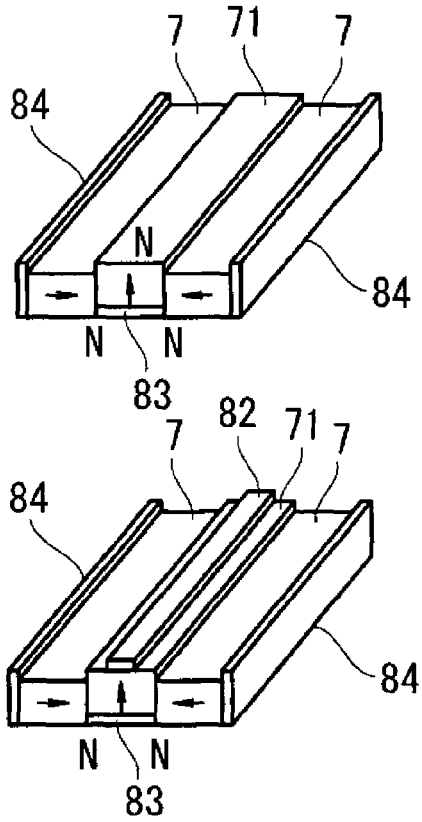
FIG. 24 illustrates perspective views showing other examples of the direct current magnetic field generator.
Figure 30:
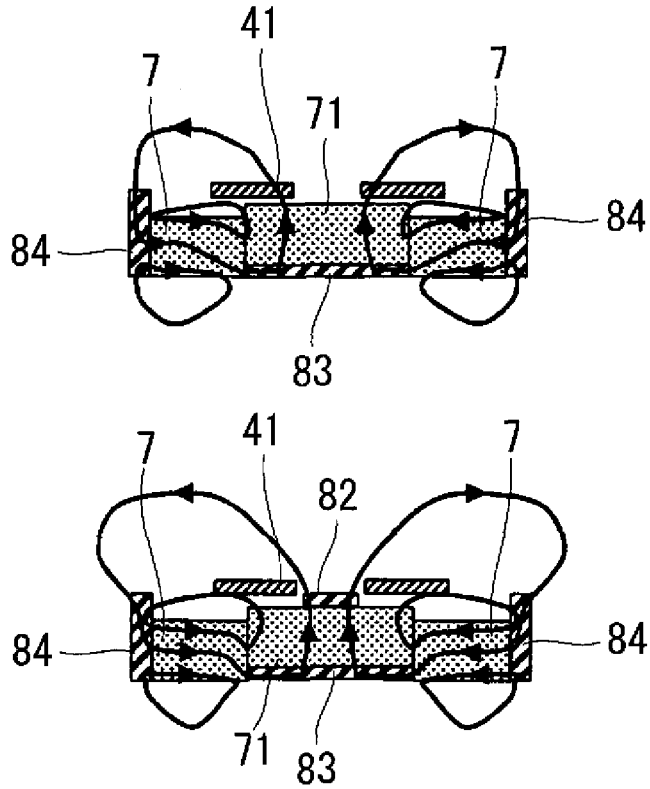
FIG. 30 illustrates sectional-views showing magnetic flux loops formed by other direct current magnetic field generators.
Figure 31:
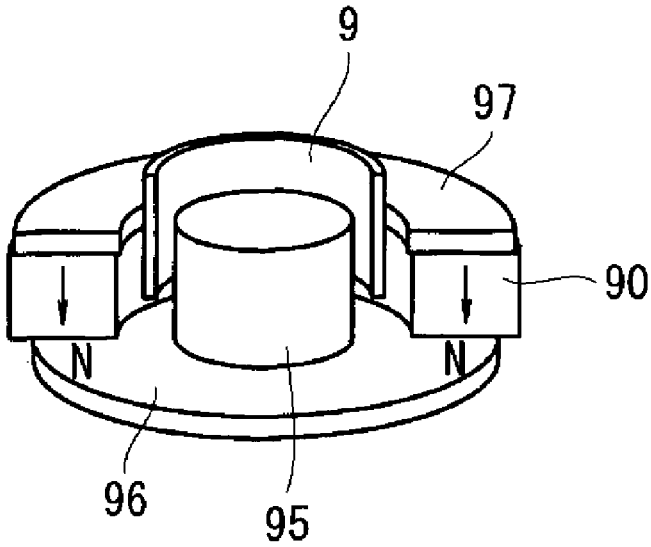
FIG. 31 PRIOR ART
FIG. 31 is a partially broken perspective view of a conventional loudspeaker.
Figure 32:
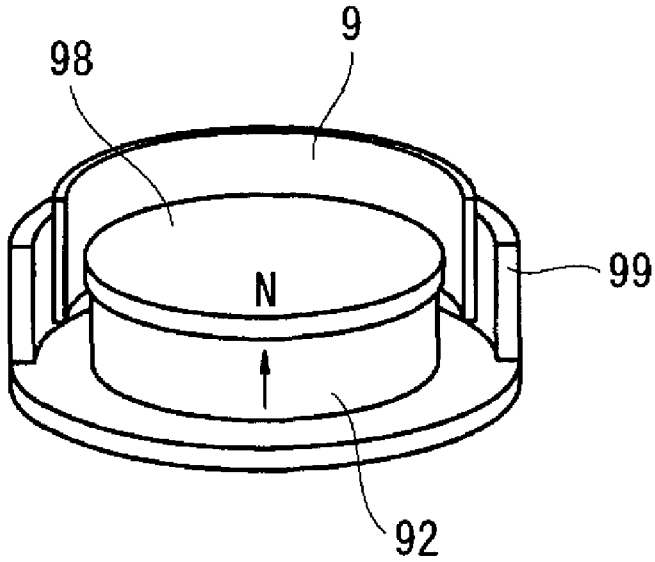
FIG. 32 PRIOR ART
FIG. 32 is a partially broken perspective view of another conventional loudspeaker.
Figure 33:
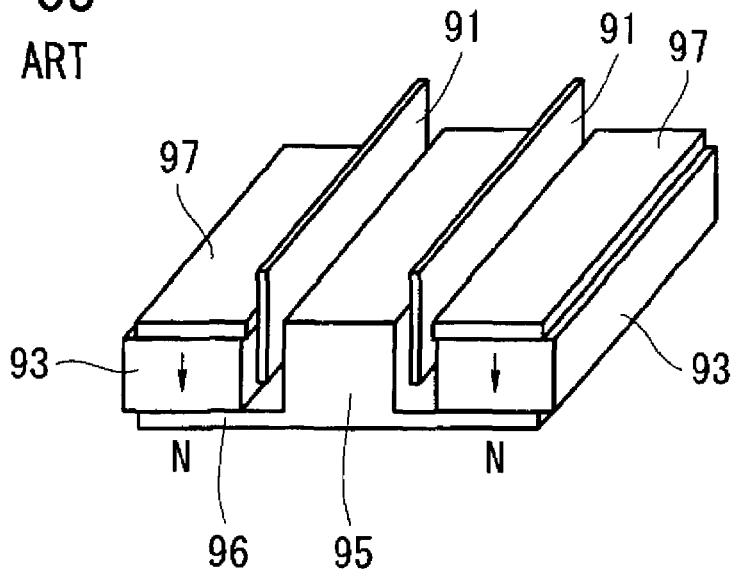
FIG. 33 PRIOR ART
FIG. 33 is a perspective view of another conventional loudspeaker.
Figure 34:
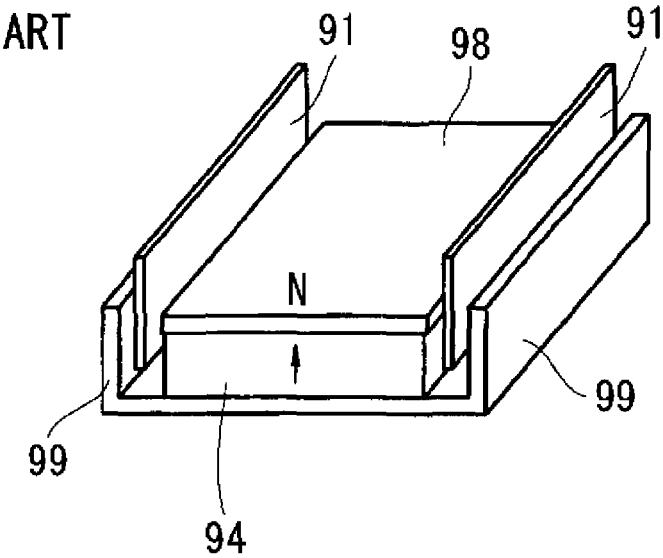
FIG. 34 PRIOR ART
FIG. 34 is a perspective view of another conventional loudspeaker.
Figure 35:
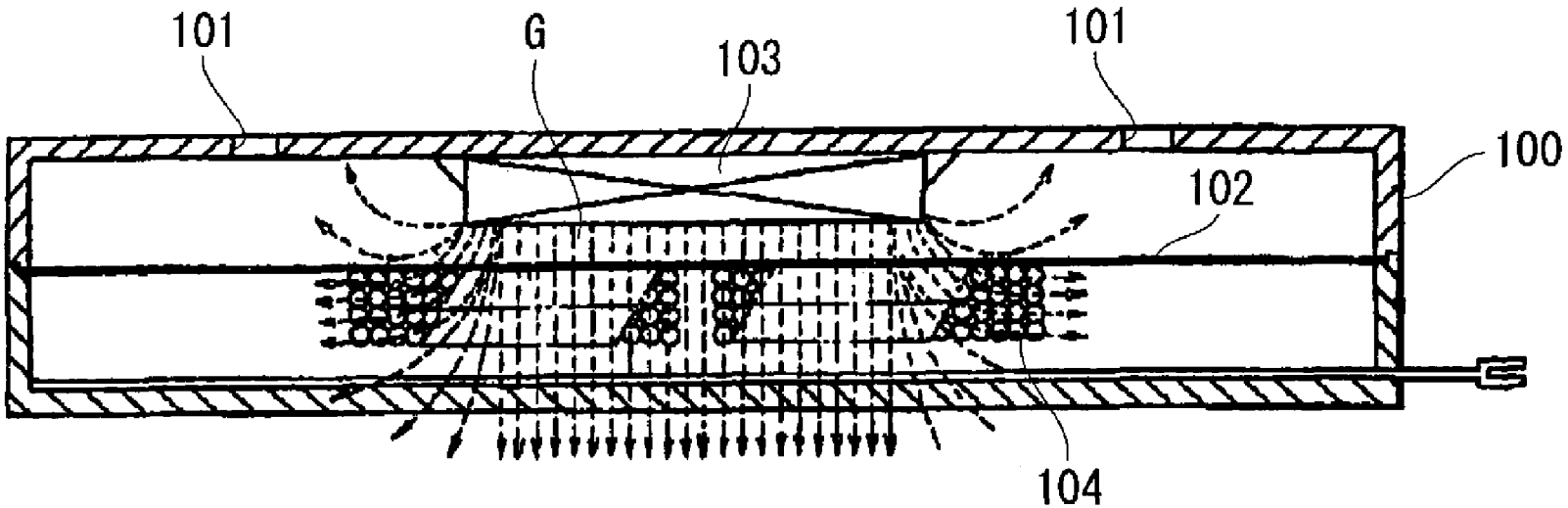
FIG. 35 PRIOR ART
FIG. 35 is a sectional view of a conventional thin loudspeaker.

Further, in the structure shown in FIG. 22(*b*), tabular side cores 84, 84, as shown in FIG. 24(*a*), formed from a ferromagnet such as iron or permalloy may be arranged on the outer side surfaces of the both outer magnets 7, 7 in such a manner to protrude toward the coil 41 beyond the front faces of the outer magnets 7, 7. With this structure, magnetic flux loops through the bottom core 83 and side cores 84, 84 as shown in FIG. 30(*a*) are formed, whereby the magnetic flux loops are attracted toward the coil 41, so that more magnetic fluxes can be applied to the coil 41.

Further, in the structure shown in FIG. 24(*a*), a strip-like top core 82, as shown in FIG. 24(*b*), formed from a ferromagnet such as iron or permalloy may be arranged on the front face of the inner magnet 71. With this structure, magnetic flux loops through the bottom core 83, side cores 84, 84 and top core 82 as shown in FIG. 30(*b*) are formed, whereby the magnetic flux loops are attracted toward the coil 41, so that more magnetic fluxes can be applied to the coil 41. Especially the lines of magnetic force between the top core 82 and the side cores 84 are changed in direction to be perpendicular to the axis of the coil 41, so that an increased magnetic flux horizontal component can be applied to the coil 41.

As described above, in any of the embodiments and structures of the present invention, the coil is wound into a flat shape, and therefore the device can be made thinner as a whole. In addition, the device can provide a sufficient sound pressure even when it is made smaller/thinner, because an inner core or inner magnet is arranged in the central hole of a ring-shaped outer magnet or between a pair of outer magnets to effectively apply to the coil the magnetic flux loops formed around the inner peripheral surface or inner surfaces of the outer magnet(s), whereby the diaphragm can be driven with a great force.

What is claimed is:

1. An electroacoustic transducer comprising:

a diaphragm having a periphery as a fixed end;

a coil having an axis perpendicular to the diaphragm and attached centrally to the diaphragm; and a magnetic field generator fixed in position as spaced apart from the coil by a gap provided axially of the coil, the diaphragm being to be driven by applying to the coil a magnetic flux emitted from the magnetic field generator, wherein the magnetic field generator comprises:

a ring-shaped outer magnet located coaxially with the axis of the coil and magnetized in the direction perpendicular to the axis; and an inner core comprising a ferromagnet and located in the central hole of the outer magnet.

2. The electroacoustic transducer according to claim 1, wherein on a front face of the magnetic field generator that faces the coil, the surface of the inner core protrudes toward the coil beyond the surface of the outer magnet.

3. The electroacoustic transducer according to claim 1, wherein on a rear face of the magnetic field generator that is opposite to the coil facing surface, a bottom core comprising a ferromagnet is located over the outer magnet and the inner core.

4. An electroacoustic transducer comprising:

a diaphragm having a periphery as a fixed end;

a coil having an axis perpendicular to the diaphragm and attached centrally to the diaphragm; and a magnetic field generator fixed in position as spaced apart from the coil by a gap provided axially of the coil, the diaphragm being to be driven by applying to the coil a magnetic flux emitted from the magnetic field generator, wherein the magnetic field generator comprises:

a ring-shaped outer magnet located coaxially with the axis of the coil and magnetized in the direction perpendicular to the axis; and an inner magnet located in the central hole of the outer magnet, the inner magnet being magnetized in the direction parallel to the axis of the coil, and placed such that the polarity of the outer magnet toward the inner periphery is the same as the polarity of the inner magnet toward the coil.

5. The electroacoustic transducer according to claim 4, wherein on a front face of the magnetic field generator that faces the coil, the surface of the inner magnet protrudes toward the coil beyond the surface of the outer magnet.

6. The electroacoustic transducer according to claim 5, wherein on a rear face of the magnetic field generator that is opposite to the coil facing surface, the rear face of the inner magnet is depressed from the rear face of the outer magnet.

7. The electroacoustic transducer according to claim 6, wherein a bottom core comprising a ferromagnet is located on the rear face of the inner magnet.

8. The electroacoustic transducer according to claim 5, wherein a cylindrical side core is arranged on the outer peripheral surface of the outer magnet and protrudes toward the coil beyond a front face of the outer magnet that faces the coil.

9. The electroacoustic transducer according to claim 4, wherein a top core comprising a ferromagnet is located on a front face of the inner magnet that faces the coil.

10. The electroacoustic transducer according to claim 1, wherein the coil is placed in a position where a winding existence region between the inner peripheral surface and outer peripheral surface thereof overlaps with the inner peripheral surface of the outer magnet.

11. The electroacoustic transducer according to claim 4, wherein the coil is placed in a position where a winding existence region between the inner peripheral surface and outer peripheral surface thereof overlaps with the inner peripheral surface of the outer magnet.

12. The electroacoustic transducer according to claim 1, wherein a distance A between the inner peripheral surface of the outer magnet and the inner peripheral surface of the coil in the direction perpendicular to the axis is arranged to be a half value, or an approximate value thereof, of a width dimension L between the inner peripheral surface and outer peripheral surface of the coil in the direction perpendicular to the axis.

13. The electroacoustic transducer according to claim 4, wherein a distance A between the inner peripheral surface of the outer magnet and the inner peripheral surface of the coil in the direction perpendicular to the axis is arranged to be a half value, or an approximate value thereof, of a width dimension L between the inner peripheral surface and outer peripheral surface of the coil in the direction perpendicular to the axis.

14. An electroacoustic transducer comprising:

a diaphragm having a periphery as a fixed end;

a coil having an axis perpendicular to the diaphragm and attached centrally to the diaphragm; and a magnetic field generator fixed in position as spaced apart from the coil by a gap provided axially of the coil, the diaphragm being to be driven by applying to the coil a magnetic flux emitted from the magnetic field generator, wherein the magnetic field generator comprises:

a pair of oppositely located outer magnets in the form of a rectangular parallelepiped having therebetween a central axis coaxial with the axis of the coil and magnetized in the direction perpendicular to the axis; and an inner core comprising a ferromagnet located between both outer magnets, and and wherein both the outer magnets and the inner core are in close contact with each other.

15. The electroacoustic transducer according to claim 14, wherein on a front face of the magnetic field generator that faces the coil, the surface of the inner core protrudes toward the coil beyond the surfaces of the outer magnets.

16. The electroacoustic transducer according to claim 14, wherein on a rear face of the magnetic field generator that is opposite to the coil facing surface, a bottom core comprising a ferromagnet is located over the inner core and the both outer magnets.

17. An electroacoustic transducer comprising:

a diaphragm having a periphery as a fixed end;

a coil having an axis perpendicular to the diaphragm and attached centrally to the diaphragm; and a magnetic field generator fixed in position as spaced apart from the coil by a gap provided axially of the coil, the diaphragm being to be driven by applying to the coil a magnetic flux emitted from the magnetic field generator, wherein the magnetic field generator comprises:

a pair of oppositely located outer magnets in the form of a rectangular parallelepiped having therebetween a central axis coaxial with the axis of the coil and magnetized in the direction perpendicular to the axis; and an inner magnet located between the both outer magnets, the inner magnet being magnetized in the direction parallel to the axis of the coil, and placed such that the polarity of the both outer magnets toward the inside is the same as the polarity of the inner magnet toward the coil.

18. The electroacoustic transducer according to claim 17, wherein on a front face of the magnetic field generator that faces the coil, the surface of the inner magnet protrudes toward the coil beyond the surfaces of the outer magnets.

19. The electroacoustic transducer according to claim 18, wherein on a rear face of the magnetic field generator that is opposite to the coil facing surface, the rear face of the inner magnet is depressed from the rear faces of the outer magnets.

20. The electroacoustic transducer according to claim 19, wherein a bottom core comprising a ferromagnet is located on the rear face of the inner magnet.

21. The electroacoustic transducer according to claim 18, wherein tabular side cores are arranged on both side surfaces of the both outer magnets and protrude toward the coil beyond front faces of the outer magnets that face the coil.

22. The electroacoustic transducer according to claim 17, wherein a top core comprising a ferromagnet is located on a front face of the inner magnet that faces the coil.

23. The electroacoustic transducer according to claim 14, wherein the coil is placed in a position where a winding existence region between the inner peripheral surface and outer peripheral surface thereof overlaps with the inner side surfaces of the both outer magnets.

24. The electroacoustic transducer according to claim 17, wherein the coil is placed in a position where a winding existence region between the inner peripheral surface and outer peripheral surface thereof overlaps with the inner side surfaces of the both outer magnets.

25. The electroacoustic transducer according to claim 14, wherein a distance A between the inner side surface of the outer magnet and the inner peripheral surface of the coil in the direction perpendicular to the axis is arranged to be a half value, or an approximate value thereof, of a width dimension L between the inner peripheral surface and outer peripheral surface of the coil in the direction perpendicular to the axis.

26. The electroacoustic transducer according to claim 17, wherein a distance A between the inner side surface of the outer magnet and the inner peripheral surface of the coil in the direction perpendicular to the axis is arranged to be a half value, or an approximate value thereof, of a width dimension L between the inner peripheral surface and outer peripheral surface of the coil in the direction perpendicular to the axis.

* * * * *